US008393943B2

(12) United States Patent
Rotter

(10) Patent No.: US 8,393,943 B2
(45) Date of Patent: Mar. 12, 2013

(54) ROOF RIDGE VENT SYSTEM

(76) Inventor: Martin J. Rotter, Glenside, PA (US)

( * ) Notice: Subject to any disclaimer, the term of this patent is extended or adjusted under 35 U.S.C. 154(b) by 107 days.

(21) Appl. No.: 12/485,534

(22) Filed: Jun. 16, 2009

(65) Prior Publication Data

US 2009/0253368 A1 Oct. 8, 2009

Related U.S. Application Data

(63) Continuation of application No. 11/046,940, filed on Jan. 31, 2005, now abandoned, which is a continuation-in-part of application No. 10/677,832, filed on Oct. 2, 2003, now abandoned.

(60) Provisional application No. 60/415,377, filed on Oct. 2, 2002.

(51) Int. Cl.
*F24F 7/02* (2006.01)

(52) U.S. Cl. ..... 454/365

(58) Field of Classification Search ..... 454/365
See application file for complete search history.

(56) References Cited

U.S. PATENT DOCUMENTS

| | | | |
|---|---|---|---|
| 1,717,728 | A | 6/1929 | Moore |
| 4,450,663 | A | 5/1984 | Watkins |
| 4,876,950 | A | 10/1989 | Rudeen |
| 4,924,761 | A | 5/1990 | MacLeod et al. |
| 4,942,699 | A | 7/1990 | Spinelli |
| 5,002,816 | A | 3/1991 | Hofmann et al. |
| 5,167,579 | A | 12/1992 | Rotter |
| 5,427,571 | A | 6/1995 | Sells |
| 5,826,383 | A | 10/1998 | Garrison |
| 5,830,059 | A | 11/1998 | Sells |
| 6,015,343 | A | 1/2000 | Castillo et al. |
| 6,267,668 | B1 | 7/2001 | Morris |
| 6,286,273 | B1 | 9/2001 | Villela et al. |
| 6,298,613 | B1 | 10/2001 | Coulton et al. |
| 6,343,985 | B1 | 2/2002 | Smith |
| 6,595,849 | B2 | 7/2003 | Miller |
| 6,598,353 | B1 | 7/2003 | Reeves |

*Primary Examiner* — Steven B McAllister
*Assistant Examiner* — Helena Kosanovic
(74) *Attorney, Agent, or Firm* — Volpe and Koenig, P.C.

(57) ABSTRACT

A roof ventilation system for asphalt shingle or composition roofs which include a vent slot located through the roof structure along a roof ridge is provided. An unrollable vent assembly that is installable in one piece is formed from an upper water barrier having first and second vent arrangements connected thereto, and each of the first and second vent arrangements include at least two continuous longitudinal strips of a vent material with a continuous longitudinally extending space therebetween separating the strips. The strips and the longitudinally extending space are positionable on the roof parallel to the ridge so that the first and second vent arrangements are located on each side of the ridge vent slot, respectively. The vent system prevent ingress of moisture and debris, and the upper water barrier extends between the first and second vent arrangements and over the vent slot in the installed position.

15 Claims, 2 Drawing Sheets

ROOF RIDGE VENT SYSTEM

CROSS REFERENCE TO RELATED APPLICATION

This application is continuation of U.S. application Ser. No. 11/046,940, filed Jan. 31, 2005, which is a continuation-in-part of U.S. application Ser. No. 10/677,832, filed Oct. 2, 2003, which claims the benefit of U.S. Provisional Patent Application No. 60/415,377, filed Oct. 2, 2002, which are incorporated by reference herein as if fully set forth.

BACKGROUND

The present invention relates to a ridge vent for roofs, and in particular to a ridge vent for use on asphalt shingle or other composition roofs, preferably having a pitch of at least 2/12.

It has been known to ventilate attics under gable roofs by running a vent along the roof ridge. Such vents are created during construction by sizing the uppermost row of sheathing panels to leave an open slot running along the ridge essentially the length of the roof. The slot creates effective heat ventilation by convection flow and suction caused by wind across the roof ridge.

Soffit ventilators are perforated or louvered openings located along the eaves of an overhanging roof. The vents allow fresh ambient air to flow into the attic to equalize attic temperature and pressure with the outside. This equalization inhibits moisture from condensing on insulation and wood roofing materials which causes mildew and rot, prevents build-up of ice dams which could buckle shingles and gutters, and reduces air-conditioning costs when hot attic air is replaced by cooler ambient air.

A soffit ventilation system works in conjunction with a ridge vent to provide passive ventilation. As hot stale air is withdrawn from the ridge slot vent by convection and/or wind suction, it is replaced by fresh ambient air through the soffit vents.

One known ridge vent that has proven to be very successful is described in the inventor's prior U.S. Pat. No. 5,167,579. This roof vent is formed using a non-woven synthetic fiber mat having randomly aligned fibers located over a vent slot at the roof ridge. Cap shingles are then installed over the non-woven synthetic fiber mat. The synthetic fiber mat allows for air flow through the slot at the roof ridge, while preventing the ingress of moisture and debris. However, while this type of vent has proven effective at stopping the ingress of most moisture coming up the roof slope, for example due to wind driven rain, it cannot prevent moisture ingress from above, such as when wind driven rain is oriented parallel to the roof ridge line, forcing water between the cap shingles, where it then can pass directly down through the vent material.

Other known systems utilize an open-celled foam material with an upper membrane of closed cell that covers the ridge vent slot. However, this comes in short lengths that must be pieced together. Additionally, the foam materials can retain moisture in the cells due to the meniscus forces of the water in the open cells, reducing the effective ventilation area.

Depending on the installation techniques used, generally all of the prior known systems can allow leakage due to wind driven rain.

It would therefore be desirable to provide a roof ridge vent system that allows for easy and consistent installation by roofing installers and which provides effective ridge ventilation while preventing moisture ingress.

SUMMARY

Briefly stated, the present invention provides a roof ridge vent system for asphalt shingle or composition roofs which include a vent slot located through the roof structure along the roof ridge. An unrollable vent assembly is provided that can be cut to length and installed in one piece. The vent assembly is comprised of an upper water barrier having first and second vent arrangements connected thereto. Each of the first and second vent arrangements include at least two longitudinal strips of a vent material with a longitudinally extending space that extends parallel to the roof ridge therebetween. The first and second vent arrangements are located on each side of the ridge vent slot, respectively, to prevent ingress of moisture and debris. The upper water barrier extends between the first and second vent arrangements and over the vent slot in the installed position.

A ridge cap is installed over the vent assembly. A water dam may be formed on, connected to or inserted in a slot in a lower surface of the strip of vent material adjacent to the vent slot.

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
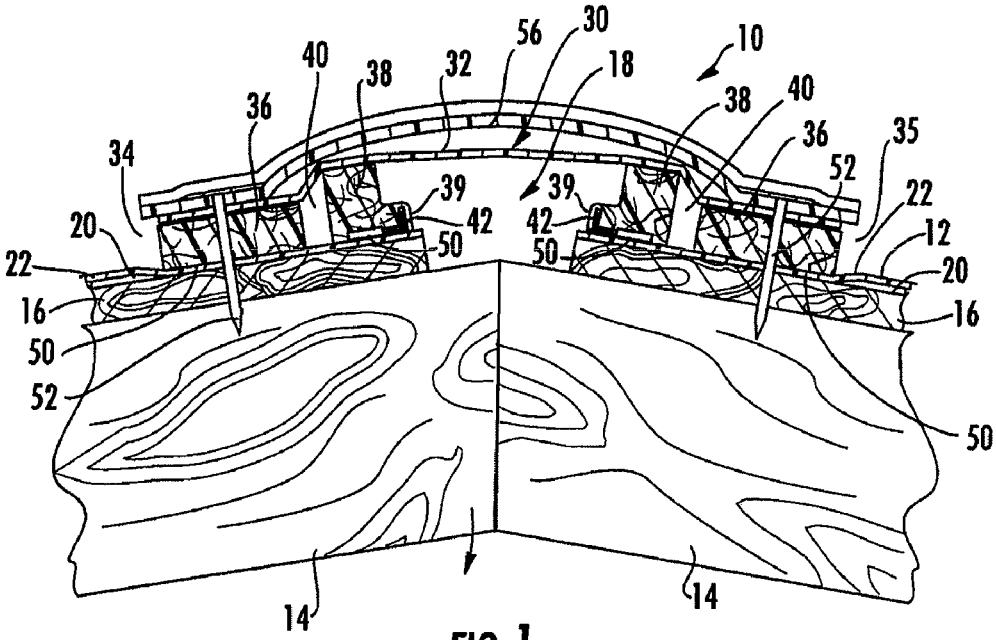
FIG. 1 is a cross-sectional view of a roof ridge vent system in accordance with a first preferred embodiment of the present invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures where like numerals represent like elements throughout.

Referring now to FIG. 1, a roof ridge ventilation system 10 is shown. The ventilation system 10 is installed on a roof 12, preferably having a 2/12 pitch or greater. The roof 12 is formed from rafters 14 having a sheathing 16, as shown, installed thereon. Alternatively, purlins or other support structures can be utilized. The sheathing 16 may end below the ridge peak or may be cut back so that a vent slot 18 is formed at the peak. Preferably, tar paper, roofing felt, or another type of moisture impervious layer 20 is installed over the sheathing 16 prior to asphalt shingles 22, another type of composition roofing material, or any other generally flat roofing material being installed up to the vent slot 18.

A vent assembly 30 in accordance with a first preferred embodiment of the present invention is then installed over the roof ridge. The vent assembly 30 is comprised of an upper water barrier 32 having first and second vent arrangements 34, 35 located thereon. Each of the first and second vent arrangements 34, 35 include at least two longitudinal strips 36, 38 of vent material with a longitudinally extending space 40 therebetween. The strips of vent material 36, 38 are preferably formed from a non-woven matting as described in U.S. Pat. No. 5,167,579, which is incorporated herein by reference as if fully set forth. However, other vent materials could be used.

The down slope strip of vent material 36 is preferably generally rectangular in cross-section and preferably has a height of about 0.6 to about 1.0 inches, and a depth of about 2 inches. The down slope strip of vent material 36 may be heat treated so that it "lofts" or expands, and then calendered down to a specific thickness to allow the completed vent strips to expand and conform to uneven surfaces when solar energy raises the roof temperature.

The up slope strip of vent material 38 preferably has a greater height than the height of the down slope strip 36, and is preferably on the order of 1 to 1.5 inches high and has a depth of about 1 inch. A foot 39 is preferably formed at the up slope side, parallel to the vent slot 18, and preferably includes a water dam 42. The water dam 42 may be provided in the form of a separate L bracket installed along the edge of the vent slot 18, or is more preferably formed from a potting material or adhesive located on or along the edge of the foot 39. The foot 39 is preferably about 0.3 to 0.5 inches high and has a depth of about 0.3 to about 0.5 inches. In the installed position, the foot 39 is located generally adjacent to the respective edge of the ridge vent slot 18.

The additional height of the up slope strip of vent material 38 ensures that the desired net free area is provided for the vent assembly 30 in the event that the water dam 42 is utilized. The water dam 42 preferably contacts and extends upwardly from the surface of the roof shingles 22 to the desired height, which should be effective to redirect water that reaches the water dam 42 back down the roof slope. The free area of the up slope strip of vent material 38 in the area of the water dam 42 remains the same as the free area of the down slope strip of vent material 36 due to the increased eight so that the net free area is not effected.

The space 40 is preferably at least 0.3 inches in width, and creates a dead zone to interrupt capillary flow of moisture along the fibers and filaments used to form the strips of vent material 36, 38. This feature alone, or in combination with the water barrier 42 results in zero moisture penetration even in the event of wind driven rain directed up the roof slope.

The first and second vent arrangements 34, 35 are located on each side of the vent slot 18, respectively. The upper water barrier 32 extends between the first and second vent arrangements 34, 35 and over the vent slot 18 in the installed position.

Figure 2:
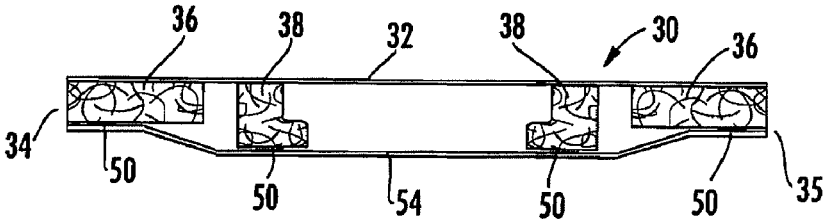
FIG. 2 is an end view of the roof ridge vent of FIG. 1.

The vent strips 34, 35 are preferably adhered to the shingles 22 by an adhesive 50 applied to at least one of the vent strips 34, 35 and the shingles 22. The adhesive 50 may include a fluid or semi-solid substance, or alternatively, the adhesive 50 may include adhesive strips, of the type known in the art, supplied pre-attached along a lower surface of each of the strips of vent material 34, 35. In the event that the adhesive strips 50 are provided on the strips of vent material 34, 35, preferably include a strip of release paper 54, as shown in FIG. 2, is applied during manufacture and can be removed during installation to reveal an adhesive such as acrylic or silicone.

The upper water barrier 32 connected to the upper surfaces of the strips of vent material 34, 35 is preferably made of a flexible polymeric material, and may be a polyvinyl chloride sheet, polyethylene or polyurethane sheet, a closed cell foam sheet or any other suitable water resistant material. The upper water barrier 32 may be connected to the strips of vent material 34, 35 by stitching, heat staking, friction, heat or solvent welding, using adhesive or any other suitable method. The upper water barrier 32 is flexible enough to allow the vent assembly 30 to be rolled for packaging and shipping, but has sufficient stiffness in the width direction so that it can not collapse into the vent slot 18.

If the water dam 42 is provided as a separate piece, preferably it has an L-shape, and is attached to the surface of the roof 12 prior to installing the vent system 32.

The ridge cap shingles 56 or other cap material are then preferably secured to the ridge using nails 52 driven through the down slope strips of vent material 36, to secure the vent assembly 30 in position.

The vent assembly 30 is preferably assembled in a continuous process, as shown in FIG. 2, using an adhesive to attach the upper water barrier 32 and the strips of vent material 36, 38, respectively. Alternatively, the water barrier 32 and strips of vent material 36, 38 are connected to the vent material 32 by stitching or other appropriate means.

Figure 3:
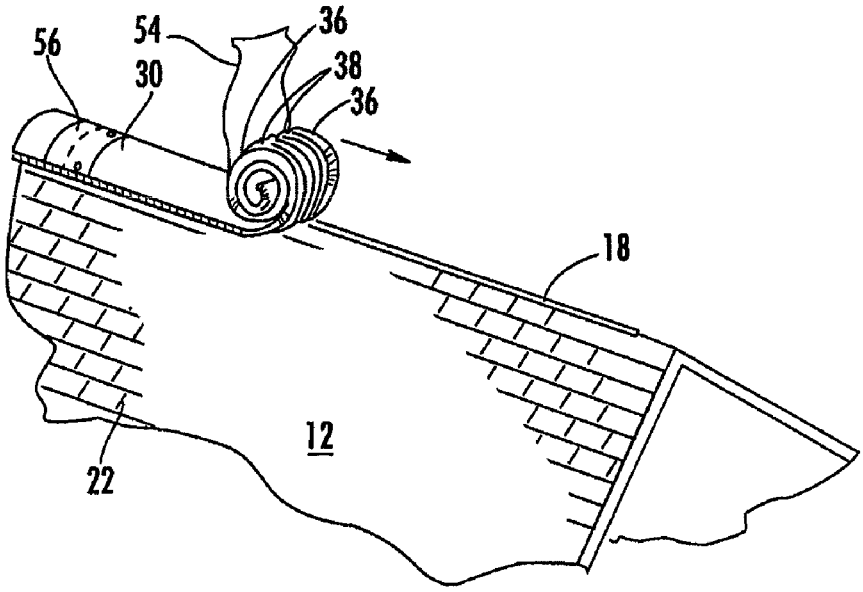
FIG. 3 is a perspective view of a roll of roof ridge vent according to the invention being installed.

Referring to FIG. 3, a rolled up coil of the vent assembly 30 is shown being installed over the ridge slot 18 of a roof structure 12. This allows easy and seamless installation along each roof ridge peak by removing the backing paper 54 and placing the vent assembly 30 in position prior to nailing or screwing it firmly in place as the cap shingles 56 are installed.

Figure 4:
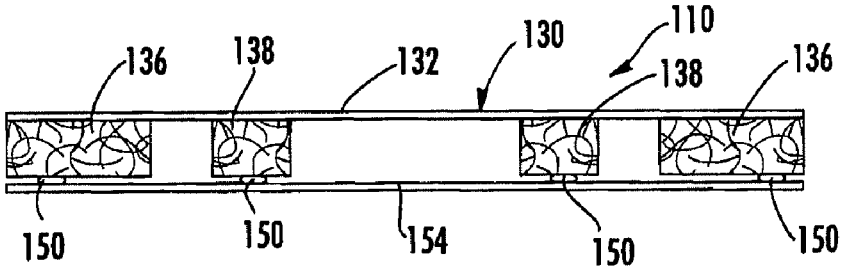
FIG. 4 a cross-sectional view of a roof ridge vent system in accordance with a second preferred embodiment of the present invention.

Referring now to FIG. 4, a ventilation system 110 according to a second preferred embodiment of the present invention is shown. In this embodiment, the vent assembly 130 includes strips of vent material 136, 138 that have generally the same height and have the longitudinally extending space 140 therebetween. The strips 136, 138 are sized to provide the same net free area so that air flow through the vent assembly 130 is not choked. If a water dam is to be utilized, the height of the material 136, 138 can be adjusted appropriately so that the same net free area is maintained.

An adhesive strip 150 is provided for attaching the vent system 110 to the roof shingles 22 during installation. The adhesive strip 150 is preferably located on the respective lower surfaces of the strips of vent material 136, 138. As described with reference to the first preferred embodiment, the adhesive 150 may include a fluid or semi-solid substance, or alternatively, adhesive strips having a release strip. A release sheet 154 is preferably located over the adhesive 150 for packaging and shipping, and is removed prior to installation. The ridge cap shingles are installed over the vent assembly 110 in the same manner as noted above.

In use, the upper water barrier 32, 132 prevents moisture, for example wind driven rain that travels parallel to the roof ridge from falling through the vent slot 18 if it passes between gaps in the ridge cap 40, or lifts a portion of the ridge cap shingles 40. The strips of vent material 36, 38; 136, 138 with the longitudinally extending air gap 40, 140 therebetween prevent the ingress of insects, debris or moisture in the upslope direction of the roof. Additionally, if the water dam 42 is utilized, this traps and redirects any moisture that may penetrate the up slope strip of vent material, so that it travels back down the roof slope, and does not enter the building structure through the ridge vent slot 18. Depending on the thickness (in a direction parallel to the roof surface) and porosity of the vent material, it is possible that the water dam 36 can be entirely omitted as shown in the second preferred embodiment of FIG. 4.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A roof ventilation system for asphalt shingle or composition roofs that include a vent slot located through the roof structure along a roof ridge comprising an unrollable vent assembly installable in one piece, the vent assembly including an upper water barrier having first and second vent arrangements connected thereto, each of the first and second vent arrangements having a length and including at least two continuous longitudinal strips of a vent material with a continuous longitudinally extending space therebetween, the strips positionable on the roof parallel to the ridge and having a length equal to the length of the vent arrangements, the strips on a down slope side of each of the vent arrangements having a down slope face area that fills a space between the upper water barrier and the roof in the installed position, the strips of vent material adapted to be along the vent slot having an up slope area having an up slope length and up slope height between the roof and water barrier in the installed position, a water dam connected to the upslope area along the up slope length of the respective up slope areas and having a dam height less than the upslope height, the first and second vent arrangements locatable on each side of the ridge vent slot, respectively, to prevent ingress of moisture and debris, and the upper water barrier above the first and second vent arrangements, extending between the first and second vent arrangements and over the vent slot in the installed position.

2. The roof ventilation system according to claim 1, further comprising at least one ridge cap placed over the vent assembly, whereby the upper water barrier is located between the ridge cap and the first and second vent arrangements.

3. The roof ventilation system according to claim 2, wherein first and second ends of the ridge cap extend past respective down slope surfaces of the strips of vent material located on a down slope sides of the vent assembly in directions opposite the vent slot.

4. The roof ventilation system according to claim 3, further comprising fasteners driven through the ridge cap and respective ones of the strips of vent material located on the down slope sides of the vent assembly to attach the ridge cap and the vent assembly to the roof.

5. The roof ventilation system according to claim 1, wherein the upper water barrier is bonded to the strips of vent material.

6. The roof ventilation system according to claim 1, wherein the strips of vent material are comprised of a non-woven mesh.

7. The roof ventilation system according to claim 6 wherein the non-woven mesh material is a synthetic fiber web treated with at least one binding agent.

8. The roof ventilation system according to claim 1, wherein the strips of vent material include an adhesive applied thereon for securing the vent assembly to the surface of the roof.

9. The roof ventilation system according to claim 8, wherein the adhesive is a pressure sensitive strip adhesive having a removable backing which exposes the pressure sensitive adhesive.

10. The roof ventilation system according to claim 1, wherein the water dam comprises an adhesive or a potting compound.

11. The roof ventilation system according to claim 1, wherein the upper water barrier is at least one of polyvinyl chloride and a closed cell foam.

12. The roof ventilation system according claim 1, wherein the water dam has a height of 0.3 to 0.5 inches.

13. The roof ventilation system according to claim 1, wherein the strips of vent material adapted to be along the vent slot of each the first and second vent arrangements have a height of approximately 1 to 1.5 inches and the strips on the down slope side of each the first and second vent arrangements have a height of approximately 0.6 to 1 inch.

14. The roof ventilation system according to claim 1, wherein the at least two longitudinal strips of vent material of each the first and second vent arrangements have a height of at least 0.6 inches.

15. The roof ventilation system according to claim 1, wherein the space between the longitudinal strips of vent material is at least 0.3 inches.

* * * * *

UNITED STATES PATENT AND TRADEMARK OFFICE

CERTIFICATE OF CORRECTION

PATENT NO. : 8,393,943 B2
APPLICATION NO. : 12/485534
DATED : March 12, 2013
INVENTOR(S) : Martin J. Rotter It is certified that error appears in the above-identified patent and that said Letters Patent is hereby corrected as shown below:

IN THE CLAIMS

Claim 1, column 5, line 26, after "position" insert -- , wherein the strips of vent material adapted to be along the vent slot of each of the first and second vent arrangements have a greater height than the strips on the down slope side of each of the respective first and second vent arrangements --.

Signed and Sealed this
Seventh Day of July, 2015

Michelle K. Lee

Michelle K. Lee
*Director of the United States Patent and Trademark Office*